US006021848A

United States Patent [19]

Breivik et al.

[11] Patent Number: 6,021,848

[45] Date of Patent: Feb. 8, 2000

[54] METHOD OF LOADING AND TREATMENT OF HYDROCARBONS

[76] Inventors: Kåre Breivik, Ugleliveien, N-4120 Tau; Martin Sigmund-Stad, Ragnhildsgate 34, N-4044 Hafrsfjord; Arne Smedal, Torjusholmen, N-4818 Faervik; Ole G. Steine, Nydalen 6, N-5040 Paradis, all of Norway

[21] Appl. No.: 08/952,809

[22] PCT Filed: May 14, 1996

[86] PCT No.: PCT/NO96/00118

§ 371 Date: Mar. 13, 1998

§ 102(e) Date: Mar. 13, 1998

[87] PCT Pub. No.: WO96/36529

PCT Pub. Date: Nov. 21, 1996

[30] Foreign Application Priority Data

May 18, 1995 [NO] Norway ..... 951977

[51] Int. Cl.[7] ..... E21B 43/01

[52] U.S. Cl. ..... 166/344; 166/267

[58] Field of Search ..... 166/267, 344, 166/350, 357

[56] References Cited

U.S. PATENT DOCUMENTS

| | | | |
|---|---|---|---|
| 4,826,354 | 5/1989 | Adorjan | 405/158 |
| 5,025,860 | 6/1991 | Mandrin | 166/267 |
| 5,431,589 | 7/1995 | Corona | 441/4 |
| 5,460,227 | 10/1995 | Sidrim | 166/357 |
| 5,878,814 | 3/1999 | Breivik et al. | 166/267 |

*Primary Examiner*—Frank Tsay

*Attorney, Agent, or Firm*—Kane, Dalsimer, Sullivan & Levy, LLP

[57] ABSTRACT

A method of loading and treatment of a gaseous or liquid hydrocarbon mixture produced on an offshore production platform, a production vessel or a well installation when producing oil and gas from a reservoir, wherein the mixture is supplied to a gas treatment vessel (12) via a buoy loading system comprising a buoy (14) of the STL/STP type, and is treated on board the vessel (12) for producing liquefied natural gas (LNG) or an LPG mixture stored in tanks on the vessel. Simultaneously with the supply of the hydrocarbon mixture, oil is also supplied to the vessel (12) via the same buoy (14), the buoy including a multi-course STP connector, the oil being transferred directly from the STP connector via a pipeline (23) and an unloading means (25) on the vessel (12) to a tanker (13) for storage and transport of the supplied oil.

3 Claims, 4 Drawing Sheets

METHOD OF LOADING AND TREATMENT OF HYDROCARBONS

FIELD OF THE INVENTION

The present invention relates to a method of loading and treatment of a gaseous or liquid hydrocarbon mixture produced on an offshore production platform, a production vessel or a well installation when producing oil and gas from a reservoir, wherein the mixture is supplied to a gas treatment vessel via a buoy loading system comprising a buoy of the STL/STP type, and is treated on board the vessel for producing liquefied natural gas (LNG) or an LPG mixture stored in tanks on the vessel.

BACKGROUND OF THE INVENTION

In offshore production of hydrocarbons (oil and gas) it is known to use production vessels based on the so-called STP technique (STP=Submerged Turret Production). In this technique there is used a submerged buoy of the type comprising a central bottom-anchored member communicating with the topical underground source via at least one flexible riser, and which is provided with a swivel unit for the transfer of fluid under a high pressure to a production plant on the vessel. On the central buoy member there is rotatably mounted an outer buoyancy member which is arranged for introduction and releasable securement in a submerged, downwardly open receiving space at the bottom of the vessel, so that the vessel is able to turn on the anchored central buoy member under the influence of wind, waves and water currents. For a further description of this technique reference may e.g. be made to Norwegian laying-open print No. 176 129 and to international patent application No. PCT/NO94/00119.

In offshore loading and unloading of hydrocarbons it is also known to use a so-called STL buoy (STL=Submerged Turret Loading) which is based on the same principle as the STP buoy, but which has a simpler swivel means than the STP swivel which normally has several through-going passages or courses. For a further description of this buoy structure reference may e.g. be made to international patent application No. PCT/NO92/00056.

By means of the STL/STP technique there is achieved that one is able to carry out loading/unloading as well as offshore production of hydrocarbons in nearly all weathers, a connection as well as a disconnection between vessel and buoy being able to be carried out in a simple and quick manner, also under very difficult weather conditions with high waves. Further, the buoy may remain connected to the vessel in all weathers, a quick disconnection being able to be carried out if a weather limitation should be exceeded.

SUMMARY OF THE INVENTION

The object of the invention is to provide a flexible system for simultaneous loading of oil and gas via an STL/STP buoy to one or more vessels.

For the achievement of the above-mentioned object there is provided a method of the introductorily stated type which, according to the invention, is characterized in that, simultaneously with the supply of the hydrocarbon mixture, oil is also supplied to the gas treatment vessel via said buoy, the buoy including an STP connector having pipe courses for the respective fluids, the oil being transferred directly from the STP connector via a pipeline and an unloading means on the vessel to a tanker for storage and transport of the supplied oil.

By means of the method according to the invention there is obtained a very flexible system for simultaneous loading of oil and gas via a loading buoy to one or more vessels. Further, there is achieved that one can load oil and simultaneously can harvest LPG (Liquefied Petroleum Gas) and/or gas which would otherwise be reinjected into the reservoir.

BRIEF DESCRIPTION OF THE DRAWINGS

The invention will be further described below in connection with examplary embodiments with reference to the accompanying drawings, wherein.

DESCRIPTION OF THE PREFERRED EMBODIMENTS

Figure 1:
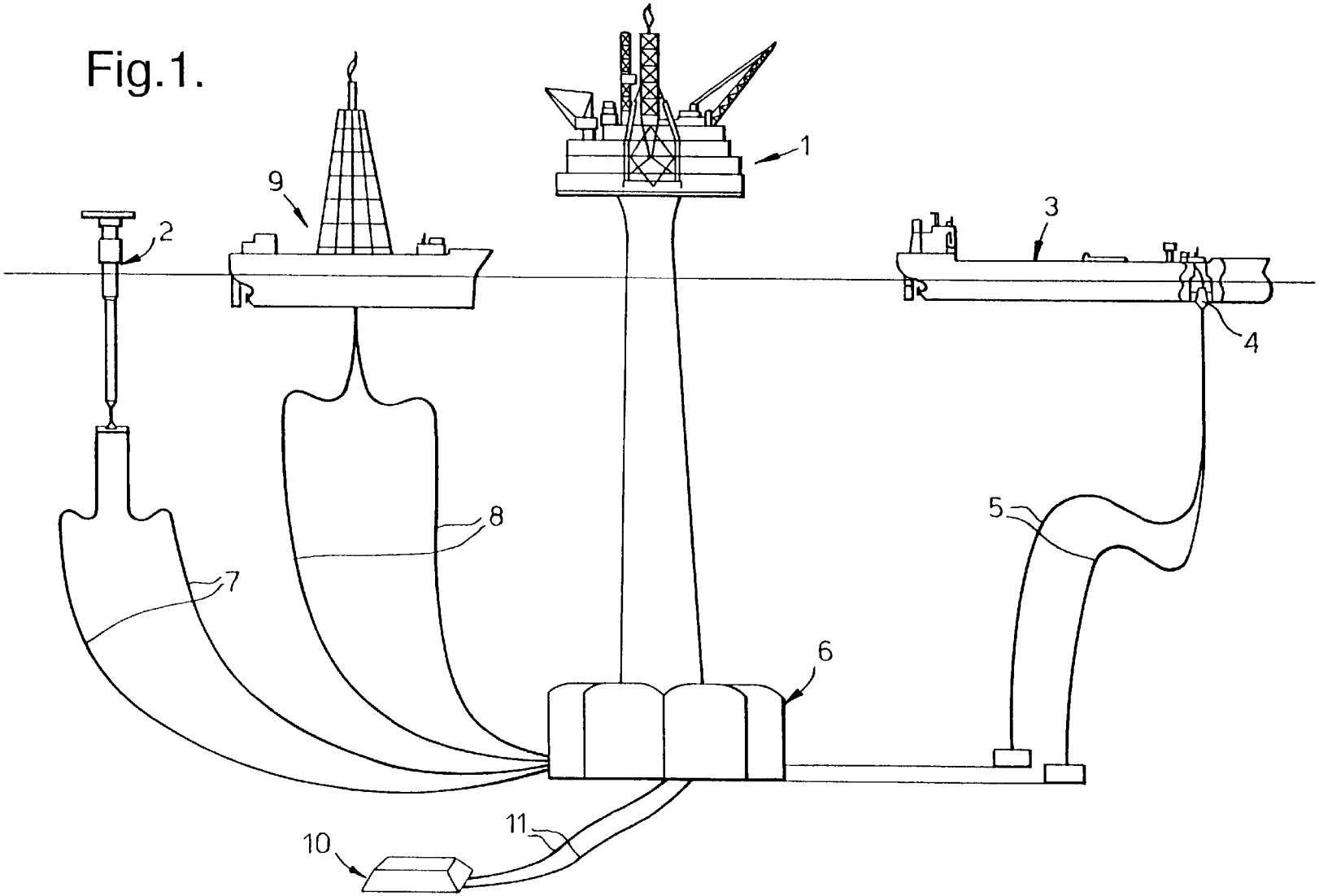
FIG. 1 shows a schematic view of an offshore installation and a vessel for the supply of gas and/or an LPG mixture.

FIG. 1 shows a production platform 1, a conventional floating loading buoy 2 and a vessel 3 which is anchored to a submerged, bottom-anchored buoy 4 (the anchoring system is not shown) of the introductorily mentioned STL for STP type, the buoy 4 being introduced and secured in a submerged receiving space at the bottom of the vessel. A number of risers 5 for transport of hydrocarbons from the production platform 1 extend between the base 6 of the platform and the buoy 4. Similar risers 7 and 8, respectively, extend between the platform base and the loading buoy 2 and a production vessel 9, respectively. Further, there is shown a production well 10 which communicates with a reservoir (not shown) and which is connected to the platform 1 through flowlines 11.

Previously, it has been customary to reinject LPG and/or gas, so that the value of this hydrocarbon fraction has not been utilized. However, with the system shown in FIG. 1, this hydrocarbon fraction may be utilized, in that the risers 5 constitute pipe courses for gas and/or LPG of this type, so that the gas or the LPG mixture is supplied to the vessel 3 via the buoy 4, the buoy then cooperating with a suitable STP connector. The vessel 3 may be an LPG or an LNG vessel, for treatment of the topical gas or LPG mixture. Normally, it will be necessary to return some of the gas, and this is done via one of the risers 5.

Figure 2:
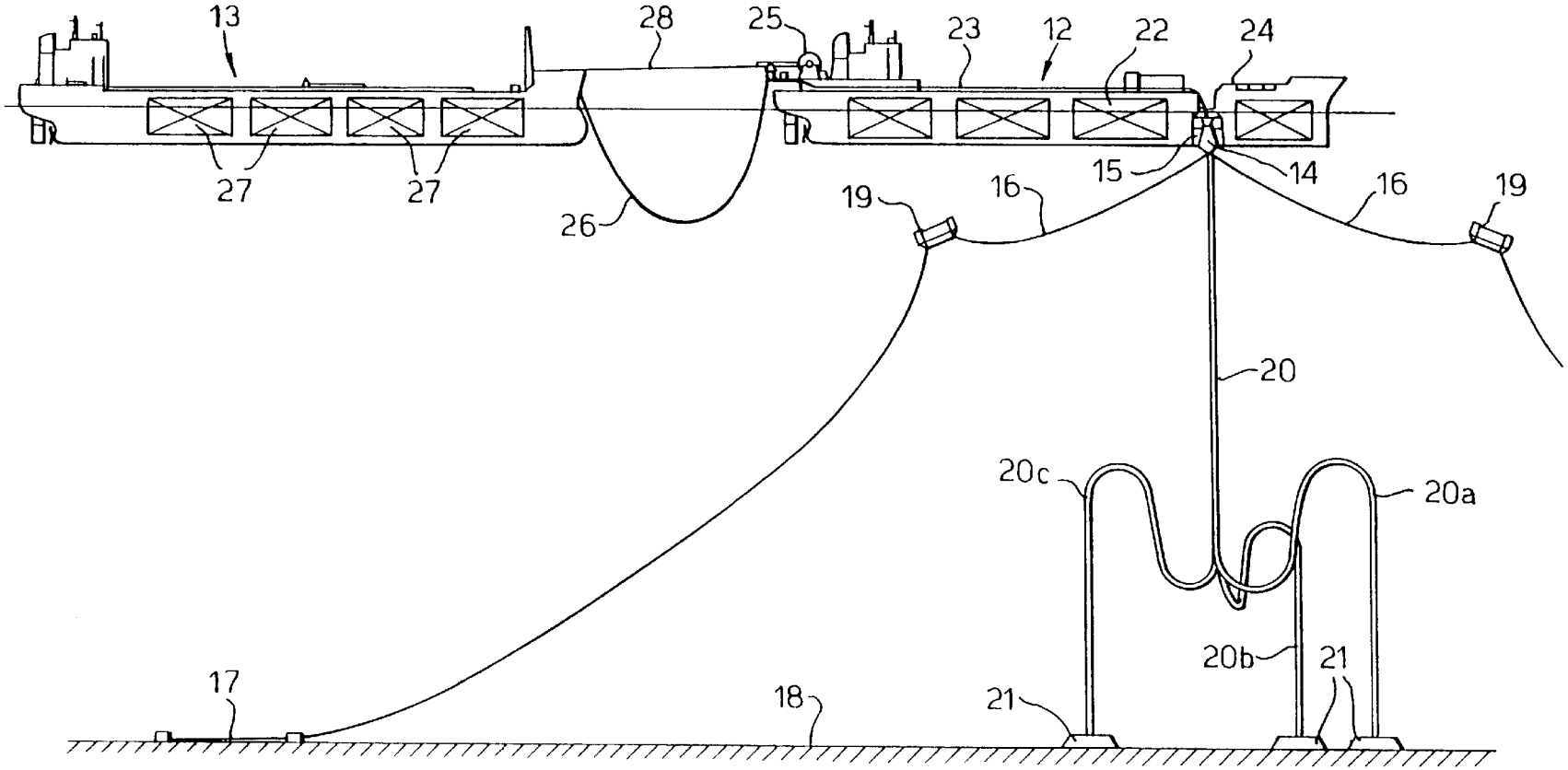
FIG. 2 shows a schematic view of interconnected vessels for carrying out the method according to the invention.

FIG. 2 shows a system comprising interconnected vessels for use in carrying out the method according to the invention.

As shown, the system comprises a first vessel 12 which in this case is presupposed to be an LPG production vessel, and a second vessel 13 in the form of an oil tanker. The vessel 12 is anchored to an STP buoy 14 which is secured in a submerged receiving space 15 at the bottom of the vessel and which is connected to an anchoring or mooring system comprising mooring lines 16 connected to chain sections 17 at the sea bed 18. Buoyancy elements 19 are attached to the mooring lines 16 to facilitate the mooring. In practice the ocean depth may be several thousand meters with such a system.

A number of risers 20 extend between the sea bed 18 and the STP buoy 14, the risers at the bottom being connected to respective fastening or base members 21. In this case the risers comprise a riser 20*a* for transport of oil, a riser 20*b* for transport of LPG or gas, and a riser 20*c* for return of gas. At their upper ends the risers are connected to respective pipe courses in the bottom-anchored central member (not further shown) of the buoy 14, and the buoy cooperates with an STP connector (also called rotating connector) which is adapted for transfer of the topical fluids to or from the production vessel 12 (see FIG. 3). This is shown to comprise a number of tanks 22 for storage of the topical product, i.e. LPG mixture in the present case.

Hydrocarbons in liquid or gaseous condition are supplied to the risers from platforms, production vessels, production wells or other suitable installations, e.g. as shown in FIG. 1.

As mentioned, the vessel 12 in this case is a production vessel for LPG mixture, and therefore it has no capacity for storage of oil which is supplied through the risers 20 simultaneously with the hydrocarbon mixture. The supplied oil therefore is transferred directly from the STP connector via a pipeline 23 which is shown to extend along the deck 24 of the vessel, to an unloading means 25. Between the unloading means 25 and the second vessel, i.e. the oil tanker 13, there is arranged a pipeline 26, and the oil is transported through this pipeline to tanks 27 on board the oil tanker. The oil tanker 13 is moored to the production vessel 12 by means of a mooring line 28. In this manner it is possible to load or supply oil and gas/LPG to two different vessels via one and the same STL/STP buoy 14.

In practice it takes a relatively short time, less than 24 hours, to fill an oil tanker, whereas it takes a substantially longer time, several weeks up to months, to fill the tanks on a vessel processing gas or an LPG mixture from hydrocarbon-carrying formations.

When the production vessel 12 is ready for unloading of the processed gas, the vessel is disconnected from the loading buoy 14 in order to go to the unloading cite. The other vessel 13 may then use the buoy 14, this vessel also being presupposed to be provided with a submerged receiving space (not shown) for this purpose. As mentioned, the vessel 14 is an oil tanker, and therefore has no possibility for treatment of the gas from the topical reservoir. In order to be able to utilize the system for oil loading in this situation, there is used an insert member or adapter for modification in connection with the buoy 14, so that its pipe courses for gas transport are shut off, and so that the oil-carrying pipe courses of the buoy are used in accordance with the conventional STL concept. This modification will be further described with reference to FIG. 4.

Figure 3:
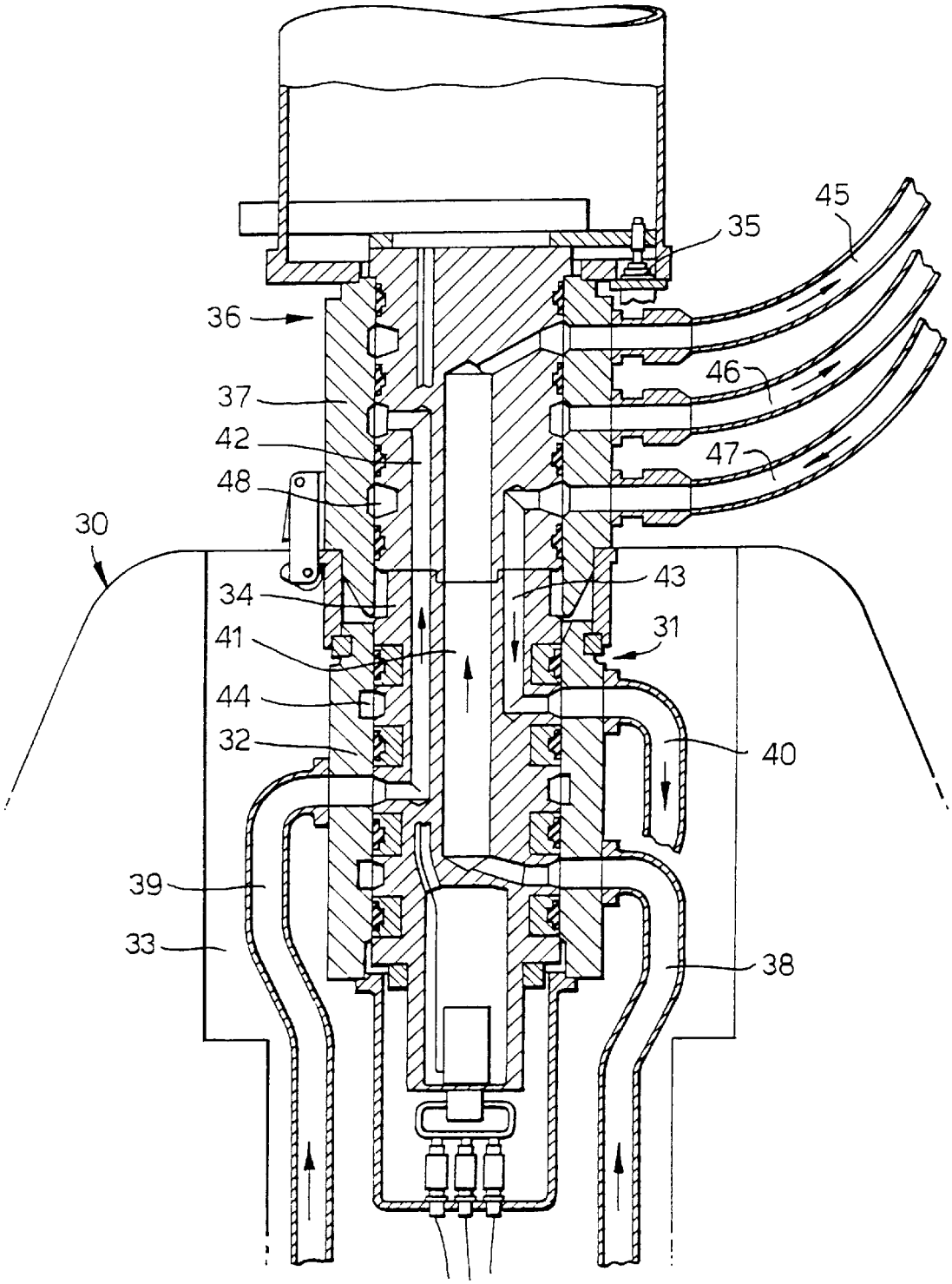
FIG. 3 shows a longitudinally sectioned view of an STP connector for use in simultaneous loading of oil and LPG mixture.

FIG. 3 shows an axial section of a rotating connector device (STP connector) 31 of the type disclosed in the aforementioned international application No. PCT/NO94/00119, and to which reference is here made for a further description thereof. Briefly stated, such a connector device includes a swivel device having a number of fluid courses for interconnection between a buoy of the above-mentioned type and a pipe system on the topical vessel, wherein the swivel device comprises a female member and a male member which can be inserted axially into or withdrawn from each other, the female member being permanently fastened to the bottom-anchored central member of the buoy.

In FIG. 3 there is suggested a buoy 30 corresponding to the buoy 14 and which is presupposed to be introduced into and secured in a receiving space in a vessel, e.g. the vessel 12. The rotating connector 31 includes a female member 32 which is permanently fitted in the upper end of the central member 33 of the buoy 30. A male member 34 is introduced into the female member, the male member being raisable and lowerable by means of a hydraulic jack 35 forming part of an operating means 36. The rotating connector also comprises a guide sleeve 37 for guiding of the male member 34.

In the illustrated embodiment the central member 33 of the buoy comprises three pipe courses for fluid transport, as described above for the buoy 14. Thus, there is provided a pipe course 38 for transfer of oil, a pipe course 39 for transfer of gas or LPG, and a pipe course 40 for return of gas. Additional pipe courses could be provided according to requirement. The male member 34 of the connector device is provided with axially extending pipe courses 41, 42, 43. The lower ends of these pipe courses communicate with respective ones of the pipe courses 38, 39, 40 via respective annular spaces 44 arranged between the male member 34 and the female member 32, whereas the upper ends of the pipe courses communicate with associated pipelines 45, 46, 47 on the vessel via respective annular spaces 48 arranged between the male member 34 and the guide sleeve 37. The rotating connector device 31 thus permits supply of oil and gas/LPG to the vessel, and return of gas from the vessel, even if the vessel together with the outer buoyancy member of the buoy turn about the bottom-anchored central member of the buoy under the influence of wind, waves and water currents.

Figure 4:
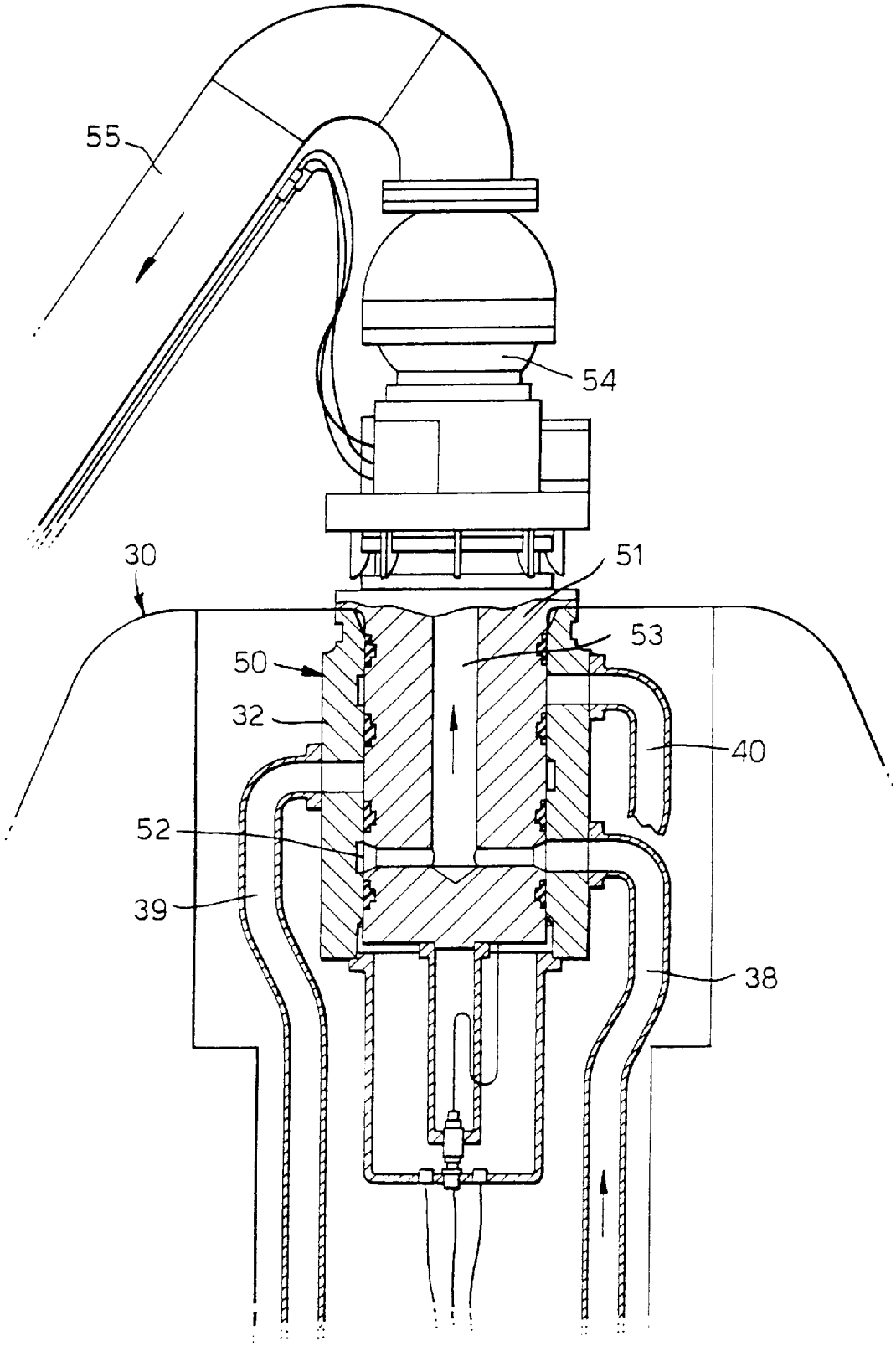
FIG. 4 shows a longitudinally sectioned view of a modified STP connector for loading of oil only.

FIG. 4 shows an axial section of an STP connector 50 which is modified to be used only for oil transfer, i.e. in accordance with the conventional STL concept, as described above. In this embodiment an insert member or adapter 51 is inserted into the female member 32 fitted in the buoy 30, which adapter is designed to shut off the pipe courses in the buoy which are not to be used, i.e. the pipe course 39 for gas/LPG and the pipe course 40 for return of gas. The adapter 51 and the female member 32 define an annular space 52 communicating with the pipe course 38 of the buoy for oil and with a pipe course 53 which extends axially through the adapter 51 and via a conventional STL coupling head 54 communicates with a pipe member 55 leading to a pipeline for oil transport, e.g. the pipeline 23 described above.

In order for the previous STP connector to be compatible with conventional STL connectors, the pipe course 53 is arranged centrally in the adapter 51. The adapter which is inserted into the STP connector, may be inserted either by the gas treatment vessel 12 or the oil tanker 13. In order to install the adapter, the male member of the STP connector firstly must be pulled up from the female member and stowed away.

As soon as the gas treatment vessel 12 is back on the field, it may connect itself to the loading buoy 30. The adapter 51 then firstly must be withdrawn from the female member 32 in the buoy, and the male member of the original STP coupling, which opens the pipe courses for transfer of the topical additional fluids, must be inserted into the female member.

We claim:

1. A method of loading and treating a gaseous or liquid hydrocarbon mixture produced on an offshore production platform, a production vessel, or a well installation when collecting oil and gas from a reservoir, comprising the steps of:

receiving a hydrocarbon mixture of liquid or gas on a gas treatment vessel with a STL/STP buoy loading system in communication with a supply source; treating the mixture on the vessel to produce liquefied natural gas (LNG) or an LPG mixture; storing the LNG or LPG mixture in tanks on the vessel; and receiving oil on the gas treatment vessel via a buoy; wherein the oil and hydrocarbon mixture of liquid or gas are received simultaneously;

and wherein the buoy includes an STP connector having pipe courses for each of the oil and hydrocarbon mixture of liquid or gas;

the collected oil being transferred directly from the STP connector via a pipeline and an unloading means on the vessel to a tanker for storage and transport of the oil.

2. The method according to claim 1 wherein the STP connector is converted to a STL-compatible connector by placing an adapter in the STP connector, the adapter having a central pipe course for collecting oil, the adapter further shutting off the pipe courses for the hydrocarbon mixture.

3. The method of claim 2, further comprised of receiving oil alone subsequent to simultaneously receiving oil and the hydrocarbon mixture by means of the STL compatible connector.

* * * * *